US009397416B2

(12) United States Patent
Mostoller et al.

(10) Patent No.: US 9,397,416 B2
(45) Date of Patent: Jul. 19, 2016

(54) ELECTRICAL CONNECTOR HAVING POKE-IN WIRE CONTACTS

(71) Applicant: Tyco Electronics Corporation, Berwyn, PA (US)

(72) Inventors: Matthew Edward Mostoller, Hummelstown, PA (US); Christopher George Daily, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/466,077

(22) Filed: Aug. 22, 2014

(65) Prior Publication Data

US 2016/0056551 A1 Feb. 25, 2016

(51) Int. Cl.

| | |
|---|---|
| ***H01R 4/48*** | (2006.01) |
| ***H01R 13/44*** | (2006.01) |
| *H01R 12/51* | (2011.01) |
| *H01R 105/00* | (2006.01) |
| *H01R 13/506* | (2006.01) |
| *H01R 13/59* | (2006.01) |
| *H01R 13/627* | (2006.01) |
| *H01R 24/30* | (2011.01) |
| *H01R 24/86* | (2011.01) |

(52) U.S. Cl.

CPC ..... *H01R 4/4818* (2013.01); *H01R 4/4836* (2013.01); *H01R 13/44* (2013.01); *H01R 4/4827* (2013.01); *H01R 4/4845* (2013.01); *H01R 12/515* (2013.01); *H01R 13/506* (2013.01); *H01R 13/59* (2013.01); *H01R 13/6273* (2013.01); *H01R 24/30* (2013.01); *H01R 24/86* (2013.01); *H01R 2105/00* (2013.01)

(58) Field of Classification Search

CPC .. H01R 4/4818; H01R 4/4836; H01R 4/4827; H01R 12/515; H01R 4/4845

USPC ..... 439/441, 131

See application file for complete search history.

(56) References Cited

U.S. PATENT DOCUMENTS

| | | | | |
|---|---|---|---|---|
| 7,993,156 B2 * | 8/2011 | Holste | ..... | H01R 4/4836 439/441 |
| 2013/0157520 A1 * | 6/2013 | Koellmann | ..... | H01R 4/4836 439/834 |

FOREIGN PATENT DOCUMENTS

| | | | | |
|---|---|---|---|---|
| DE | 10 2005 050399 B3 | 7/2007 | | |
| DE | 102005050399 B3 * | 7/2007 | ..... | H01R 4/4836 |
| WO | 2007 / 062327 A2 | 5/2007 | | |
| WO | WO 2007062327 A2 * | 5/2007 | ..... | H01R 4/4836 |

OTHER PUBLICATIONS

International Search Report, Application No. PCT/US2015/045785, International Filing Date, Aug. 19, 2015.

* cited by examiner

*Primary Examiner* — Abdullah Riyami
*Assistant Examiner* — Justin Kratt

(57) ABSTRACT

An electrical connector includes a housing and electrical contacts held by the housing. The electrical contacts include contact beams having wire interfaces configured to engage in physical contact with corresponding electrical wires. The contact beams are movable between closed positions and open positions. The wire interface of each contact beam is configured to engage in physical contact with the corresponding electrical wire when the contact beam is in the closed position. The wire interface of each contact beam is configured to be disengaged from physical contact with the corresponding electrical wire when the contact beam is in the open position. A release member is movably held by the housing such that movement of the release member is configured to move a plurality of the contact beams from the closed positions to the open positions thereof and thereby release a plurality of the electrical wires from the corresponding electrical contacts.

20 Claims, 6 Drawing Sheets

ELECTRICAL CONNECTOR HAVING POKE-IN WIRE CONTACTS

BACKGROUND

The subject matter described and/or illustrated herein relates generally to an electrical connector having poke-in wire contacts.

Some electrical connectors terminate electrical wires. Such electrical connectors include an electrical contact that engages an electrical wire to establish an electrical connection therebetween. The electrical contacts of some electrical connectors that terminate electrical wires are poke-in wire contacts. Poke-in wire contacts include wire interfaces that extend within a receptacle of the electrical connector. The electrical wire is inserted, or poked, into the receptacle such that the electrical wire engages, and thereby forms an electrical connection with, the wire interface of the poke-in wire contact.

Electrical connectors having poke-in wire contacts are not without their disadvantages. For example, many electrical connectors terminate multiple electrical wires. But, it may be difficult to release multiple electrical wires from the poke-in wire contacts of the electrical connector. For example, multiple electrical wires are typically individually released from an electrical connector (i.e., one at a time). It may be challenging to individually release each electrical wire because of the relatively short strip length of the electrical wires and/or because the electrical wires are rather densely arranged within the electrical connector and/or a jacketed cable that holds the electrical wires. Individually releasing multiple electrical wires from an electrical connector having poke-in wire contacts thus may be relatively time consuming and/or require greater skill, which may increase the cost of reworking, repairing, and/or replacing the electrical wires and/or various components of the electrical connector.

SUMMARY

In an embodiment, an electrical connector includes a housing and electrical contacts held by the housing. The electrical contacts include contact beams having wire interfaces configured to engage in physical contact with corresponding electrical wires. The contact beams are movable between closed positions and open positions. The wire interface of each contact beam is configured to engage in physical contact with the corresponding electrical wire when the contact beam is in the closed position. The wire interface of each contact beam is configured to be disengaged from physical contact with the corresponding electrical wire when the contact beam is in the open position. A release member is movably held by the housing such that movement of the release member is configured to move a plurality of the contact beams from the closed positions to the open positions thereof and thereby release a plurality of the electrical wires from the corresponding electrical contacts.

In an embodiment, an electrical connector includes a housing and electrical contacts held by the housing. The electrical contacts include contact beams having wire interfaces configured to engage in physical contact with corresponding electrical wires. The contact beams are movable between closed positions and open positions. The wire interface of each contact beam is configured to engage in physical contact with the corresponding electrical wire when the contact beam is in the closed position. The wire interface of each contact beam is configured to be disengaged from physical contact with the corresponding electrical wire when the contact beam is in the open position. A release member is movably held by the housing such that the release member is configured to move to an actuated position wherein the contact beams of the electrical contacts are in the open positions thereof.

In an embodiment, an electrical connector includes a housing having an approximately circular form factor, and electrical contacts held by the housing. The electrical contacts include contact beams having wire interfaces configured to engage in physical contact with corresponding electrical wires. The contact beams are movable between closed positions and open positions. The wire interface of each contact beam is configured to engage in physical contact with the corresponding electrical wire when the contact beam is in the closed position. The wire interface of each contact beam is configured to be disengaged from physical contact with the corresponding electrical wire when the contact beam is in the open position.

DETAILED DESCRIPTION OF THE DRAWINGS

Figure 1:
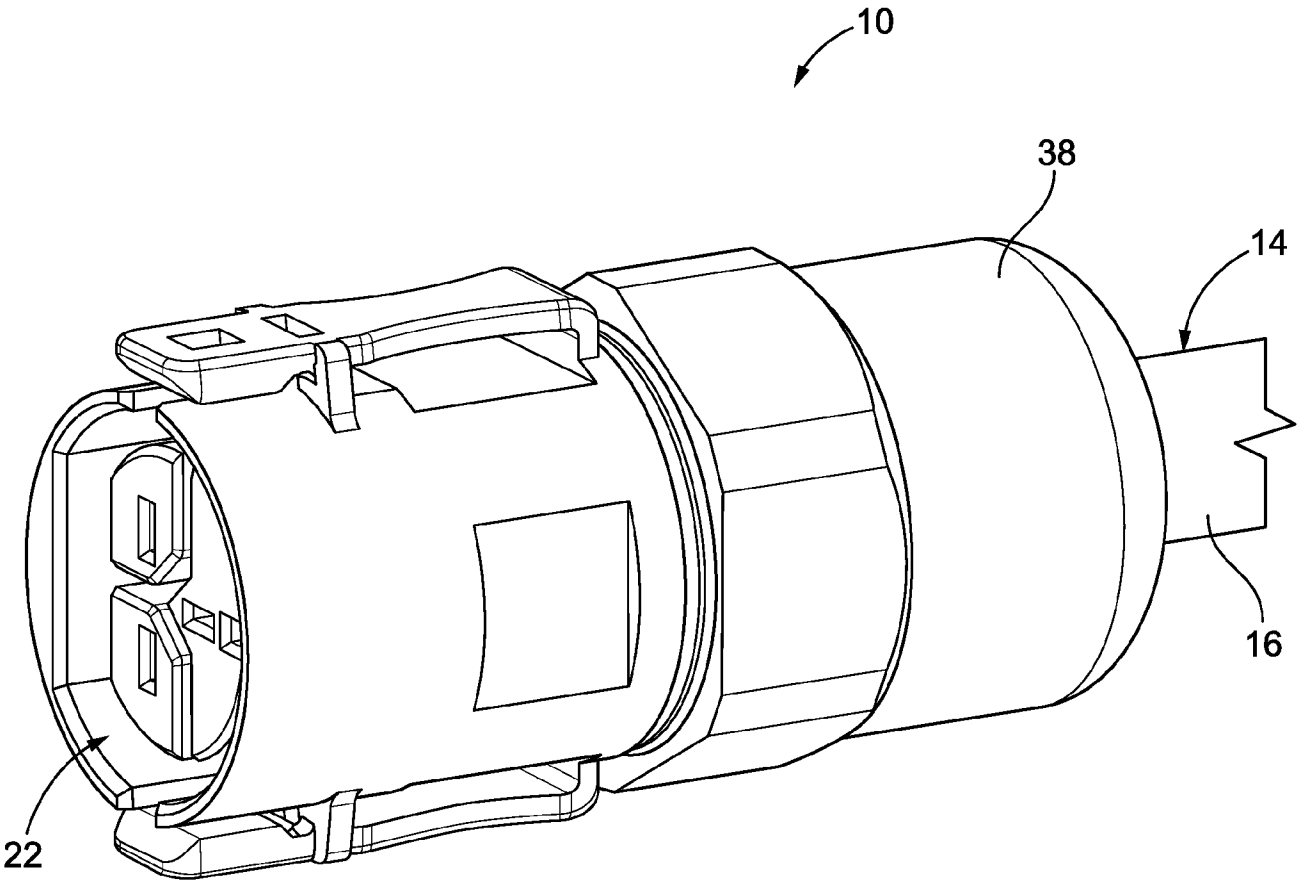
FIG. 1 is a perspective view of an embodiment of an electrical connector.
Figure 2:
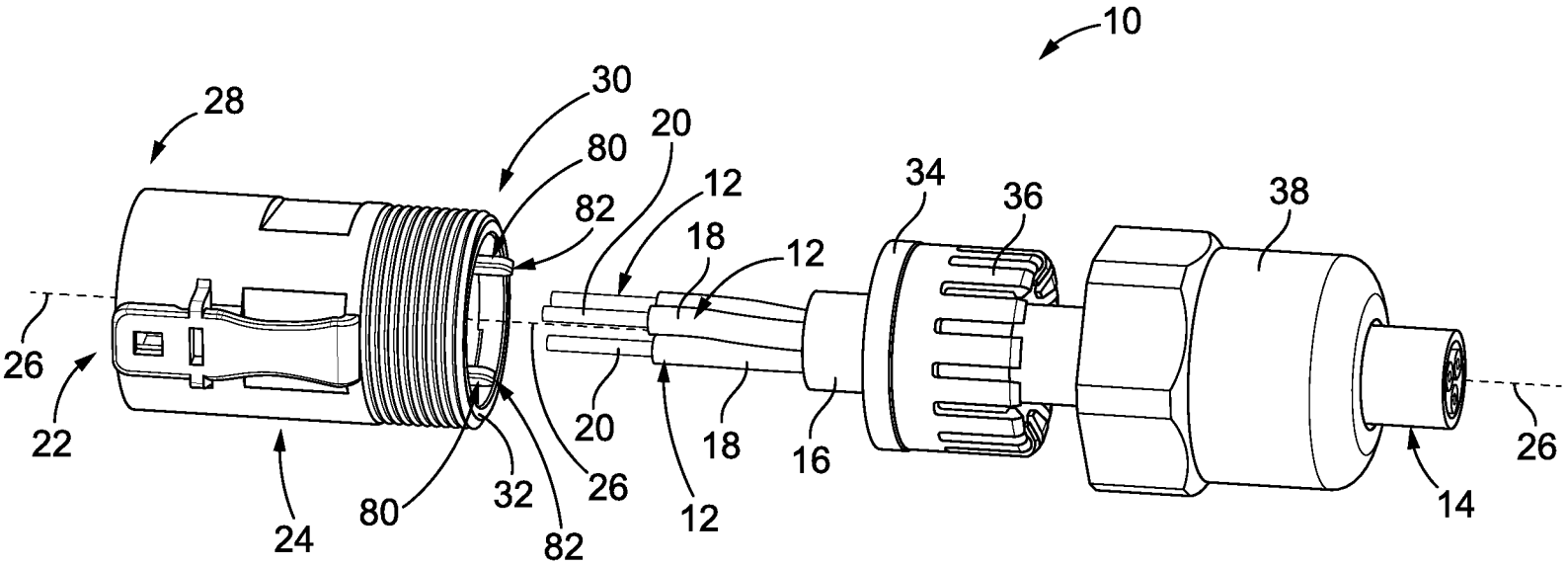
FIG. 2 is a partially exploded perspective view of the electrical connector shown in FIG. 1.

FIG. 1 is a perspective view of an embodiment of an electrical connector 10. FIG. 2 is a partially exploded perspective view of the electrical connector 10. Referring now to FIGS. 1 and 2, the electrical connector 10 is configured to electrically connect to one or more electrical wires 12 not visible in FIG. 1). Optionally, the electrical wires 12 are grouped together in a cable 14. For example, in the illustrated embodiment, the electrical wires 12 are arranged within a jacket 16 of the cable 14. As can be seen in FIG. 2, each electrical wire 12 includes an insulation layer 18 and an electrical conductor 20 in the illustrated embodiment. Although three are shown, the cable 14 may include any number of the electrical wires 12. In some other embodiments, the cable 14 does not include the jacket 16 or the electrical wires 12 are not grouped together in a cable.

In the illustrated embodiment, the electrical connector 10 is configured to mate with a complementary electrical connector (not shown). Specifically, the electrical connector 10 includes a mating interface 22 at which the electrical connector 10 is configured to mate with the complementary electrical connector such that an electrical connection is established between the electrical connector 10 and the complementary electrical connector. The mating interface 22 may additionally or alternatively include any other configuration, arrangement, and/or the like (e.g., plug, receptacle, threaded connection, and/or the like) than is shown and/or described herein. In some other embodiments, the electrical connector 10 is mounted on a substrate (not shown) for providing an electrical path between the electrical wires 12 and the substrate. In still other embodiments, the electrical connector 10 terminates one or more other electrical wires (not shown) for providing an electrical path between the electrical wires 12 and the other electrical wires. The other electrical wires may or may not be grouped together in a cable (not shown). The substrate may be any type of substrate, such as, but not limited to, a circuit board and/or the like.

Referring now solely to FIG. 2, the electrical connector 10 includes a housing 24. The housing 24 extends a length along a central longitudinal axis 26 from a mating end 28 to a cable end 30. The mating end 28 of the housing 24 includes the mating interface 22, which is better illustrated in FIG. 1. The electrical connector 10 terminates the cable 14 such that the cable 14 extends from the cable end 30 of the housing 24. The cable end 30 includes an edge 32. The electrical connector 10 optionally includes a gland seal 34, a strain relief bushing 36, and/or a gland nut 38. The gland seal 34, strain relief bushing 36, and gland nut 38 facilitate sealing the interface between the housing 24 and the cable 14, and specifically the electrical wires 12, at the cable end 30 of the housing 24.

In the illustrated embodiment, the housing 24 of the electrical connector 10, and thus the electrical connector 10 overall, has an approximately circular form factor. For example, a cross-section taken approximately perpendicularly to the central longitudinal axis 26 has an approximately circular shape, as should be apparent from FIGS. 1 and 2. In other words, and for example, the housing 24 of the electrical connector 10 has an approximately cylindrical shape between the ends 28 and 30. But, the electrical connector 10 is not limited to the circular form factor shown herein. Rather, the electrical connector 10 may have any other form factor, such as, but not limited to, an oval form factor, a relatively flat form factor, a rectangular form factor, a triangular form factor, and/or the like.

Figure 3:
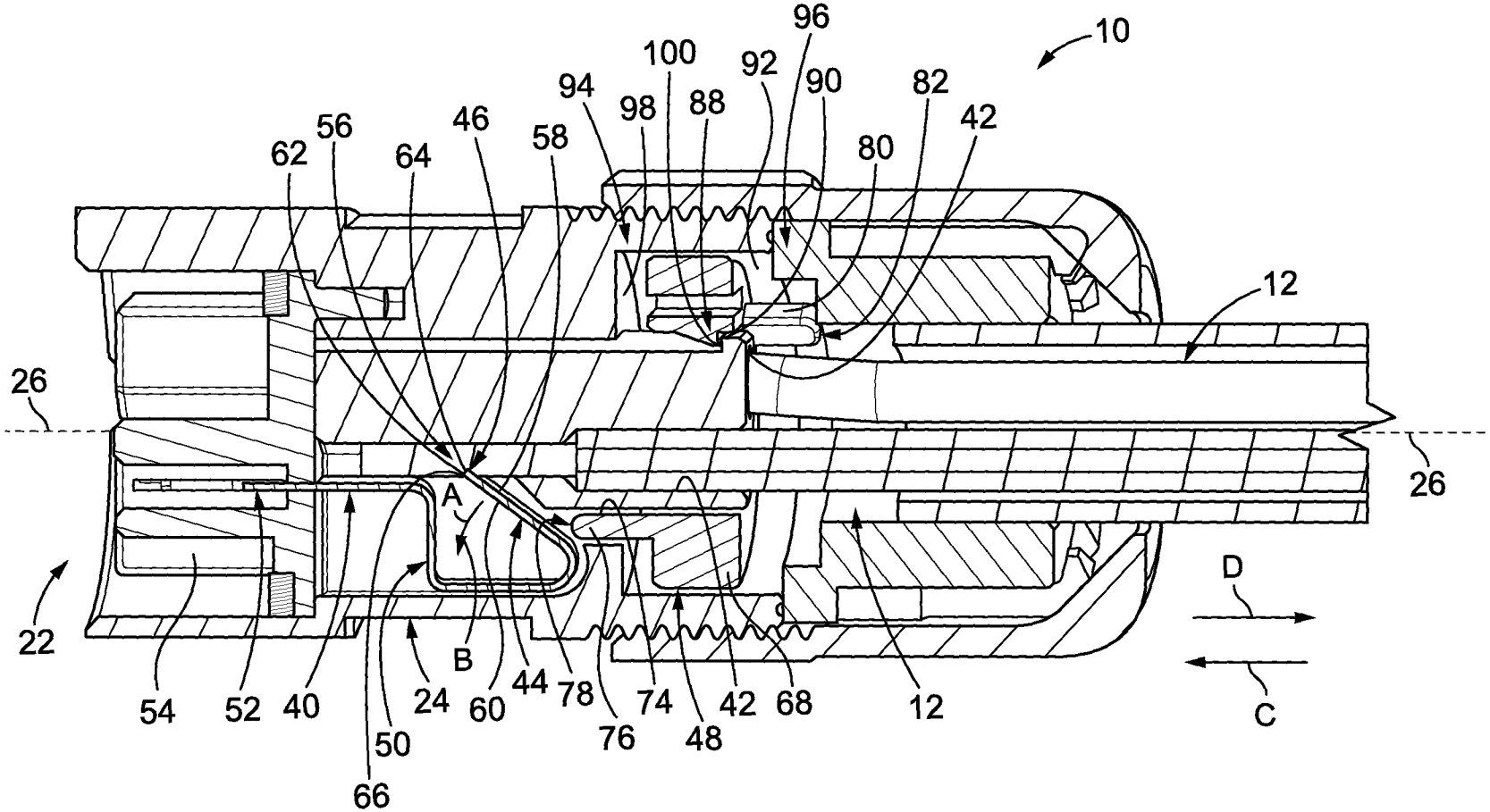
FIG. 3 is a cross-sectional view of the electrical connector shown in FIGS. 1 and 2.

FIG. 3 is a cross-sectional view of the electrical connector 10. The electrical connector 10 includes electrical contacts 40, which are held by the housing 24. Only one of the electrical contacts 40 of the illustrated embodiment is visible in FIG. 3. Optionally, the electrical contacts 40 are poke-in contacts, as is shown in the illustrated embodiment. For example, the housing 24 includes one or more receptacles 42, which can also be seen in FIGS. 4 and 6. Each receptacle 42 is configured to receive one or more corresponding electrical wires 12 therein. In other words, the electrical wires 12 are inserted (i.e., poked) into the receptacles 42. Once the electrical wires 12 are poked into the corresponding receptacle 42, each electrical wire 12 engages in physical contact with, and thereby electrically connects to, the corresponding electrical contact 40 to establish an electrical connection between the electrical connector 10 and the electrical wire 12. The housing 24 of the electrical connector 10 may include any number of the receptacles 42. Each receptacle 42 may receive any number of electrical wires 12 therein. In the exemplary embodiment, each receptacle 42 receives a single corresponding electrical wire 12 therein.

As will be described below, the electrical contacts 40 include contact beams 44 that have wire interfaces 46. The contact beams 44 are movable between open and closed positions. In the closed position, the wire interface 46 is configured to engage in physical contact with the corresponding electrical wire 12. In the open position, the wire interface 46 is configured to be disengaged from physical contact with the corresponding electrical wire 12. A release member 48 is provided for moving the contact beams 44 from the closed positions to the open positions. Moving the contact beams 44 from the closed positions to the open positions using the release member 48 releases the electrical wires 12 from the corresponding electrical contacts 40, which enable the electrical wires 12 to be removed from the corresponding receptacles 42 and thereby released from the electrical connector 10. The open positions of the contact beams 44 may also facilitate (i.e., ease) insertion of the electrical wires 12 (e.g., electrical wires 12 that are smaller than a predetermined size) into the receptacles 42.

Each electrical contact 40 includes a base 50, one or more mating segments 52, and one or more of the contact beams 44. The mating segment 52 extends from the base 50 and along the mating interface 22 of the electrical connector 10, as is shown in FIG. 3. In the illustrated embodiment, the mating segment 52 is held by an optional insert 54 that defines a portion of the mating interface 22. The insert 54 may be considered a portion of the housing 24.

The contact beam 44 extends from the base 50 to an end 56 of the contact beam 44. The contact beam 44 includes opposite sides 58 and 60 and an end side 62. The end side 62 intersects the side 58 at an edge 64 and intersects the side 60 at an edge 66. The end 56 of the contact beams 44 includes the edges 64 and 66, the end side 62, a portion of the side 58 that extends adjacent the edge 64, and a portion of the side 60 that extends adjacent the edge 66.

The contact beam 44 includes the wire interface 46 where the contact beam 44 is configured to engage in physical contact with the corresponding electrical wire 12 to thereby form an electrical connection between the electrical contact 40 and the corresponding electrical wire 12. The wire interface 46 may or may not press into the corresponding electrical wire 12 when wire interface 46 is engaged in physical contact with the corresponding electrical wire 12. In the illustrated embodiment, the wire interface 46 of the contact beam 44 is at least partially defined by the edge 64. In other words, in the illustrated embodiment, the wire interface 46 includes the edge 64. A portion of the side 58 that is adjacent the edge 64, at least a portion of the end side 62, the edge 66, and/or a portion of the side 60 may also engage in physical contact with the corresponding electrical wire 12, for example in embodiments wherein the contact beam 44 presses into the corresponding electrical wire 12. In other words, in some embodiments, the wire interface 46 includes portion of the side 58 that is adjacent the edge 64, at least a portion of the end side 62, the edge 66, and/or a portion of the side 60. Any other location(s) along the contact beam 44 may additionally or alternatively define a portion or an entirety of the wire interface 46 of the contact beam 44.

Figure 9:
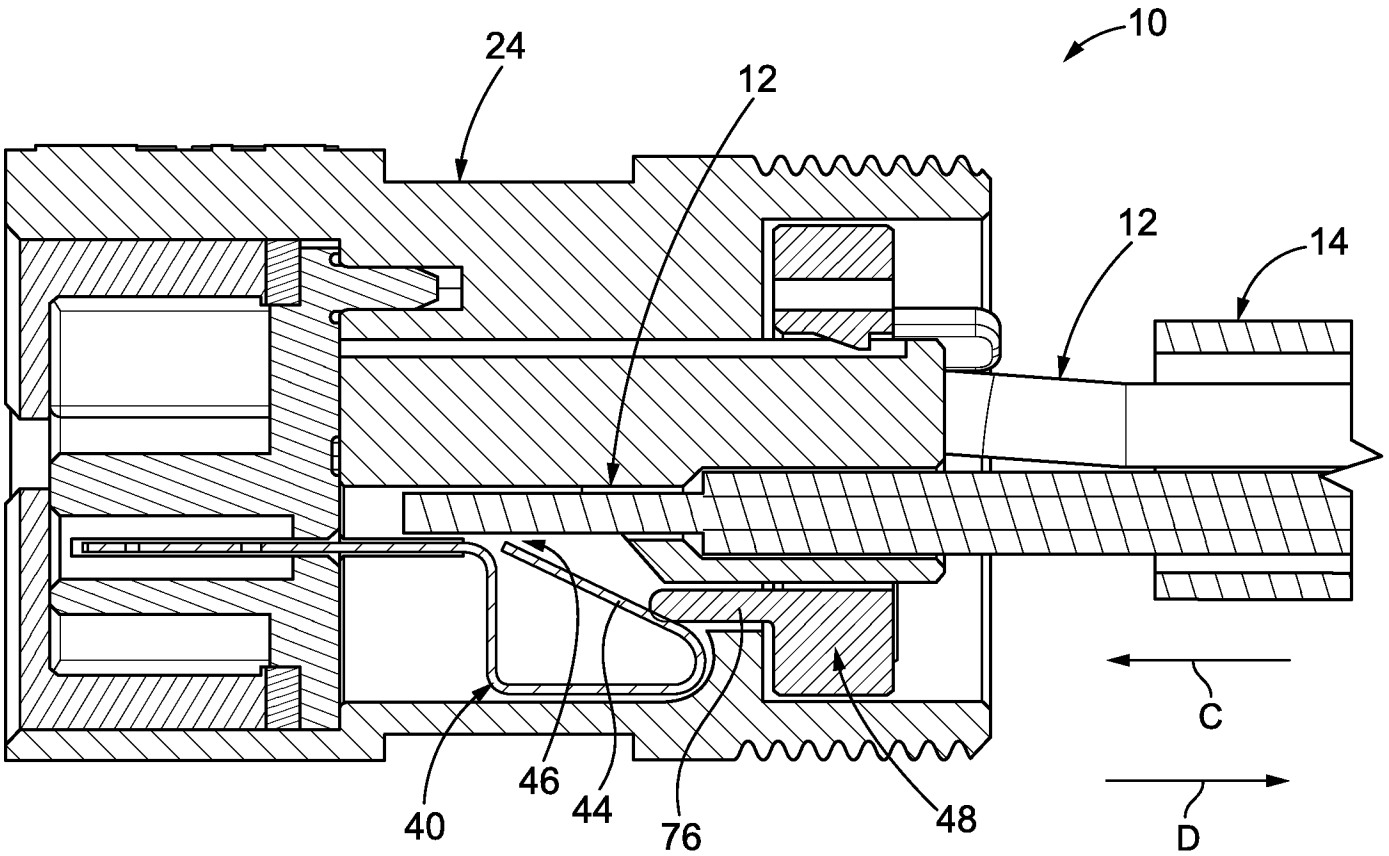
FIG. 9 is another cross-sectional view of the electrical connector shown in FIGS. 1-4 and 6-8 illustrating the release member shown in FIG. 5 in the actuated position.

The contact beam 44 is movable between an open position and one or more closed positions. Specifically, the contact beam 44 is moveable along an arc A between an open position and one or more closed positions. FIG. 9 illustrates the open position of the contact beam 44. In the open position, the contact beam 44 is configured to be disengaged from physical contact with the corresponding electrical wire 12. Specifically, the wire interface 46 of the contact beam 44 is configured to be disengaged from physical contact with the corresponding electrical wire 12 when the contact beam 44 is in the open position. In at least one closed position, the contact beam 44 is configured to engage in physical contact with the corresponding electrical wire 12 at the wire interface 46. A closed position of the contact beam 44 is shown in FIG. 3.

In the illustrated embodiment, the contact beam 44 includes a fully closed position when the corresponding electrical wire 12 is not present and the contact beam 44 includes a partially closed position when the contact beam 44 is engaged in physical contact with the corresponding electrical wire 12. FIG. 3 illustrates a partially closed position of the contact beam 44. The contact beam 44 is movable from the fully closed position to the partially closed position to accommodate the presence of the corresponding electrical wire 12. The contact beam 44 is further moveable from the partially closed position to the open position. In other words, the contact beam 44 is moveable from the fully closed position to the open position. In some other embodiments, one or more of the contact beams 44 is configured to engage in physical contact with the corresponding electrical wire 12 when the contact beam 44 is in the fully closed position.

It should be understood that the open position of the contact beam 44 depends on the size of the corresponding electrical wire 12. For example, a position of the contact beam 44 that is open (wherein the contact beam 44 does not engage in physical contact with the corresponding electrical wire 12) with respect to a smaller-sized electrical wire 12 may be closed (wherein the contact beam 44 engages in physical contact with the corresponding electrical wire 12) with respect to a larger-sized electrical wire 12. The open position of the contact beam 44 may or may not be at the end of a range of movement of the contact beam 44. In other words, as the contact beam 44 is moved from the partially closed position to the open position, the contact beam 44 may or may not disengage from physical contact with the corresponding electrical wire 12 before the contact beam 44 has reached an end of the range of movement of the contact beam 44. For example, the open position of the contact beam 44 may or may not be at the end of a range of deflection and/or an elastic range of the contact beam 44.

Optionally, one or more of the contact beams 44 is a spring that is resiliently deflectable from the fully closed position to the open position. The illustrated embodiment of the contact beam 44 is a spring that is resiliently deflectable from the fully closed position to the open position. In other words, the contact beam 44 is resiliently deflectable along the arc A in the respective direction B. The contact beam 44 is thus resiliently deflectable from the fully closed position to the partially closed position, and from the partially closed position to the open position. In some other embodiments, one or more of the contact beams 44 is movable from a closed position to an open position without being resiliently deflectable from the closed position to the open position.

The housing 24 may hold any number of the electrical contacts 40. In the illustrated embodiment, the housing 24 holds three electrical contacts 40. Each electrical contact 40 may engage in physical contact with, and thereby electrically connect to, any number of corresponding electrical wires 12. In the illustrated embodiment, each electrical contact 40 engages in physical contact with a single corresponding electrical wire 12.

Figure 4:
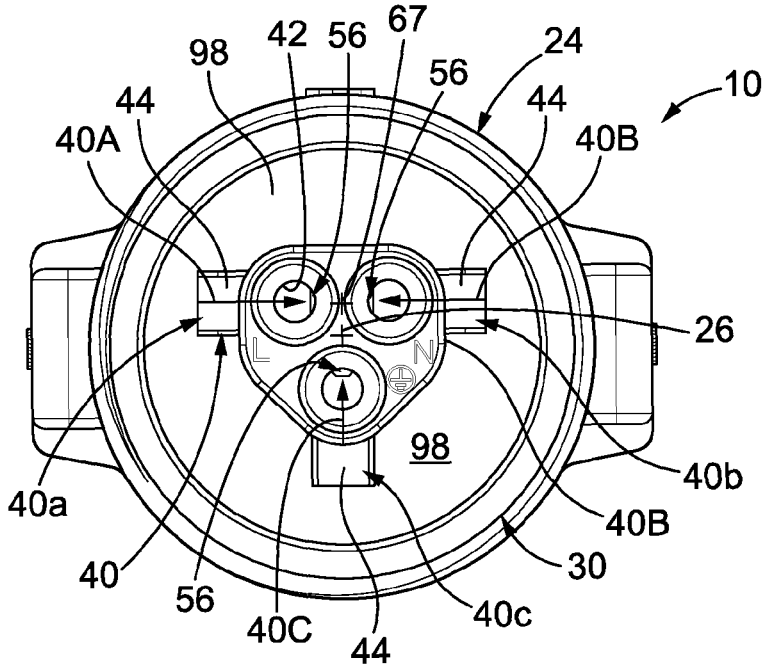
FIG. 4 is an elevational view of a portion of the electrical connector shown in FIGS. 1-3.

FIG. 4 is an elevational view of a portion of the electrical connector 10. The release member 48 (FIGS. 3, 5, and 6-9), the gland nut 38 (FIGS. 1 and 2), and the cable 14 (FIGS. 1-3 and 9) have been removed from the electrical connector 10 in FIG. 4 to illustrate the cable end 30 of the housing 24. As can be seen in FIG. 4, the contact beams 44 of the illustrated embodiment of the electrical contacts 40 extend in different directions as each other. Specifically, each of the illustrated electrical contacts 40*a*, 40*b*, and 40*c* extends outward from the base 50 to the corresponding end 56 in a respective different direction 40A, 40B, and 40C.

In the illustrated embodiment, the directions 40A, 40B, and 40C each extends generally inward (e.g., the ends 56 face generally toward the central longitudinal axis 26), and when considered together form a radially inward pattern (relative to an axis 67). But, each electrical contact 40A, 40 B, and 40 C may extend in any other direction both generally and relative to each of the other electrical contacts 40. Moreover, the directions of the various electrical contacts 40 may have any other pattern as compared to the illustrated embodiment. Examples of other directions, patterns, and/or the like include, but are not limited to, one or more of the contact beams 44 extending generally outward (e.g., in an opposite direction to the illustrated embodiment, with the end 56 facing generally away from the central longitudinal axis 26, and/or the like), a radially outward pattern relative to the axis 67, a radially inward pattern relative to the central longitudinal axis 26, a radially outward pattern relative to the central longitudinal axis 26, and/or the like.

Figure 5:
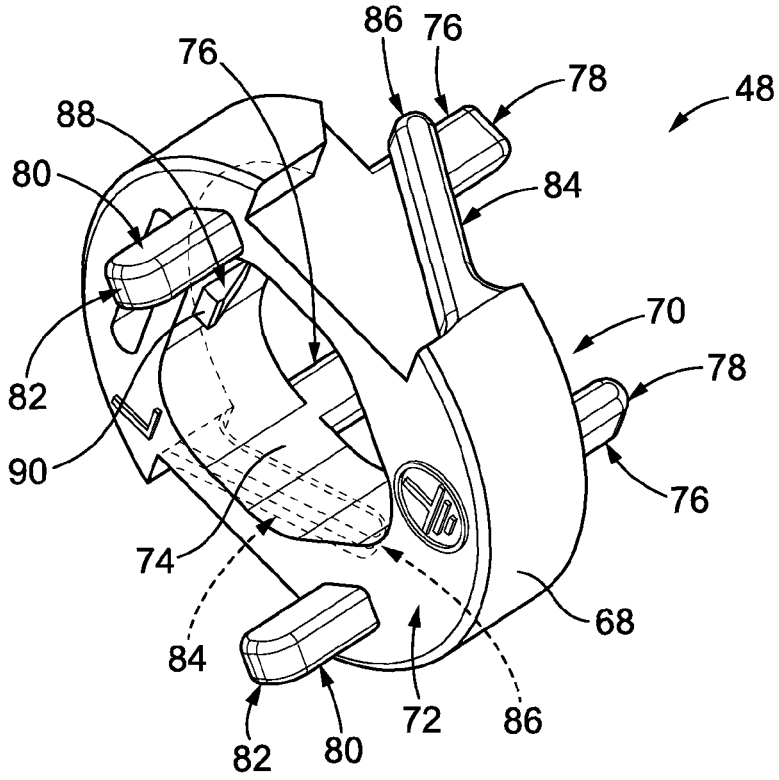
FIG. 5 is a perspective view of an embodiment of a release member of the electrical connector shown in FIGS. 1-4.

FIG. 5 is a perspective view of an embodiment of the release member 48. As will be described below, the release member 48 is configured to be movably held by the housing 24 (FIGS. 1-4 and 6-9) such that the release member 48 is configured to move relative to the housing 24. The release member 48 includes a base 68, which includes a pusher side 72 and an opposite contact side 70. The base 68 is configured to be movably held by the housing 24, as will be described below. When the release member 48 is held by the housing 24, the contact side 70 faces generally toward the electrical contacts 40 (FIGS. 3, 4, and 6-9), while the pusher side 72 faces generally away from the electrical contacts 40. In the illustrated embodiment, the base includes an optional opening 74.

The release member 48 includes one or more optional fingers 76 that extend outward from the base 68. Specifically, the fingers 76 extend outward from the contact side 70 of the base 68 to ends 78 of the fingers 76. As will be described below, the end 78 of each finger 76 is configured to engage in physical contact with one or more corresponding contact beams 44 (FIGS. 3, 4, and 6-9) to move the corresponding contact beam(s) 44 from the closed position to the open position thereof.

In the illustrated embodiment, the release member 48 includes three fingers 76. But, the release member 48 may include any number of the finger 76, which may or may not be the same as the number of electrical contacts 40. Moreover, each finger 76 may engage any number of the contact beams 44. In the illustrated embodiment, each finger 76 engages a single contact being 44. Although shown as having the general shape of a parallelepiped, each finger 76 may additionally or alternatively include any other shape that enables the finger 76 to function as described and/or illustrated herein.

The release member 48 includes one or more optional pusher extensions 80 that extend outward from the base 68. The pusher extensions 80 extend outward from the pusher side 72 of the base 68 to ends 82 of the pusher extensions 80. As will be described below, the end 82 of each pusher extension 80 is configured to be pushed against to move the release member 48 relative to the housing 24 and thereby move the fingers 76 relative to the contact beams 44. In the illustrated embodiment, the release member 48 includes two pusher extensions 80. But, the release member 48 may include any number of the pusher extensions 80. Although shown as having the general shape of a parallelepiped, each pusher extension 80 may additionally or alternatively include any other shape that enables the pusher extension 80 to function as described and/or illustrated herein.

Optionally, the release member 48 includes one or more springs 84. Each spring 84 is configured to bias the release member 48 away from the contact beams 44 to an unactuated position, as will be described below. Each spring 84 includes an end 86 that is resiliently deflectable from the natural resting position of the end 86 shown in FIG. 5. The release member 48 may include any number of the springs 84. In the illustrated embodiment, the release member 48 includes two springs 84. The springs 84 may have any arrangement, pattern, configuration, and/or the like. In the illustrated embodiment, the springs 84 are arranged opposite each other.

In the illustrated embodiment, each spring 84 is integrally formed with the base 68 as a single, unitary structure. But each spring 84 may alternatively be a discrete structure from the base 68 that is configured to be operatively connected between the base 68 and the housing 24 such that the spring 84 is configured to function as described and/or illustrated herein (e.g., as described below).

The release member 48 includes an optional stop 88 having a stop surface 90 that is configured to engage the housing 24 to limit movement of the release member 48 relative to the housing 24. The stop 88 also facilitates retaining the release member 48 to the housing 24. Optionally, the stop 88 is a resiliently deflectable snap tab that is configured to cooperate with the housing 24 with a snap-fit connection.

Figure 6:
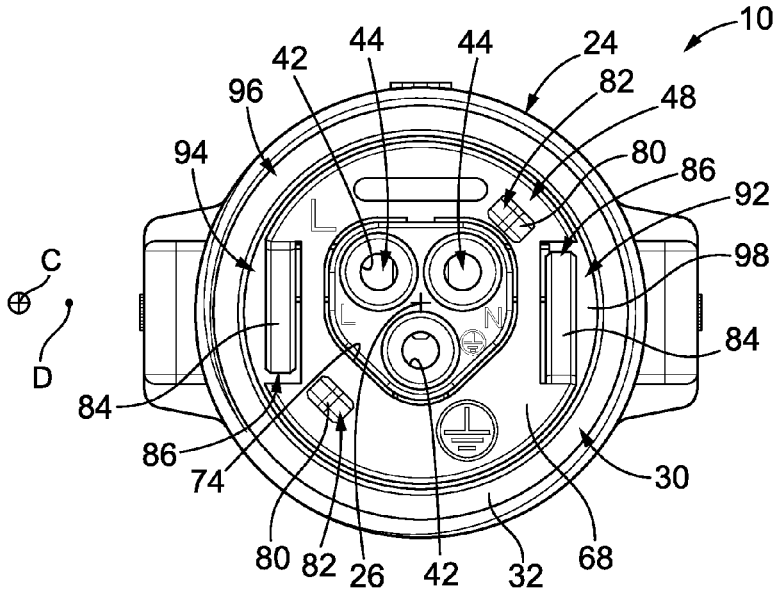
FIG. 6 is an elevational view of a portion of the electrical connector shown in FIGS. 1-4.

FIG. 6 is an elevational view of a portion of the electrical connector 10. The gland nut 38 (FIGS. 1 and 2), and the cable 14 (FIGS. 1-3 and 9) have been removed from the electrical connector 10 in FIG. 6 to illustrate the release member 48 as held by the housing 24. Referring now to FIGS. 3 and 6, the housing 24 includes an internal chamber 92, which extends along the central longitudinal axis 26 from an end 94 to an opposite end 96. The end 94 is defined by a wall 98 of the housing 24. The wall 98 is also shown in FIG. 4. The base 68 of the release member 48 is held by the housing 24 within the internal chamber 92. As shown in FIG. 3 and should be apparent from the position of the receptacles 42 in FIG. 6, in the illustrated embodiment, the electrical wires 12 (not shown in FIG. 6) extend through the optional opening 74 of the base 68 of the release member (i.e., the opening 74 receives the electrical wires 12 therethrough when the electrical wires 12 are terminated by the electrical connector 10). In other embodiments, one or more of the electrical wires 12 extends around (i.e., outside of) the release member 48 (e.g., a portion or all of the release member 48 extends between the electrical wires 12).

Referring now solely to FIG. 3, the internal chamber 92 movably receives the release member 48 therein such that the release member 48 is configured to move within the internal chamber 92 along the central longitudinal axis 26 between the ends 94 and 96. The release member 48 moves within the internal chamber 92 along the central longitudinal axis 26 between an unactuated position and an actuated position. Specifically, the release member 48 moves from the unactuated position toward the actuated position along an actuation direction C, while the release member 48 moves from the actuated position toward the unactuated position is along an unactuation direction D. FIGS. 2, 3, 6, and 7 illustrate the release member 48 in the unactuated position, while FIGS. 8 and 9 illustrate the release member 48 in the actuated position.

In the unactuated position shown in FIG. 3, the stop surface 90 of the stop 88 of the release member 48 is engaged in physical contact with a ledge 100 of the housing 24, which limits further movement of the release member 48 in the unactuation direction D. The snap tab of the stop 88 has been snap-fit over the ledge 100 to hold the release member 48 to the housing 24.

Movement of the release member 48 in the actuation direction C from the unactuated position to the actuated position causes the ends 78 of the fingers 76 of the release member 48 to engage in physical contact with the corresponding contact beams 44 and thereby move the contact beams 44 from the fully or partially closed positions to the open positions. Optionally, the ends 78 of the fingers 76 slidably engage in physical contact with the corresponding contact beams 44 to move the contact beams 44 from the fully or partially closed positions to the open positions, as provided in the illustrated embodiment. In other words, the ends 78 of the fingers 76 optionally move the contact beams 44 from the fully or partially closed positions to the open positions by sliding along the contact beams 44 in physical engagement therewith as the release member 48 moves in the actuation direction C. Movement of the release member 48 in the unactuation direction D from the actuated position to the unactuated position causes the ends of the fingers 76 to disengage from physical contact with the corresponding contact beams 44, which enables the resilience of the contact beams 44 to move (i.e., spring back) the contact beams 44 from the open positions to the fully or partially closed positions.

Referring again to FIG. 6, the release member 48 is held by the housing 24 such that the ends 86 of the springs 84 are configured to be engaged in physical contact with the wall 98 of the housing 24. The ends 86 may or may not be engaged with the wall when the release member 48 is at the limit of movement of the release member 48 in the unactuation direction D (i.e., when the stop surface 90 is engaged in physical contact with the ledge 100 as shown in FIG. 3). The springs 84 are thus configured to bias the release member 48 away from the contact beams 44 to the unactuated position. When the release member 48 is moved in the actuation direction C toward the contact beams 44, the ends 86 of the springs 84 are deflected from the natural resting position thereof and the resilience of the springs 84 provides a spring force that resists movement of the release member 48 in the actuation direction C. The release member 48 is configured to be moved in the actuation direction C against the resistance of the springs 84 by applying sufficient force to overcome the spring force provided by the springs 84.

In the illustrated embodiment, the opposite arrangement of the springs 84 may facilitate balancing the force supplied to move the release member 48 in the actuation direction C, for example to prevent the release member 48 from becoming jammed within the internal chamber 92.

The release member 48 may be moved in the actuation direction C by pushing on the ends 82 of the pusher extensions 80 using any suitable structure, mechanism, process, and/or the like, such as, but not limited to, using a person's hand, a person's thumb, a person's finger, a tool, an automated mechanism and/or machine, a manual mechanism and/or machine, and/or the like. As can be seen in FIG. 2, the ends 82 of the pusher extensions 80 optionally extend beyond the edge 32 of the cable end 30 of the housing 24, which may make it easier to access and thereby push on the release member 48 to move the release member 48 in the actuation direction C.

Figure 7:
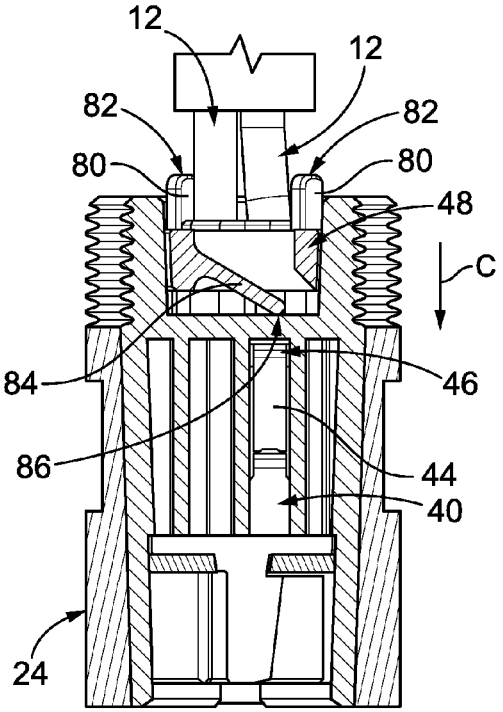
FIG. 7 is another cross-sectional view of the electrical connector shown in FIGS. 1-4 and 6 illustrating the release member shown in FIG. 5 in an unactuated position.
Figure 8:
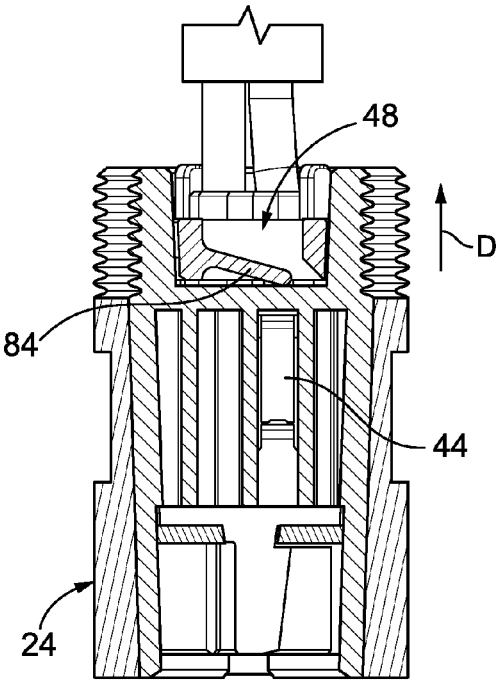
FIG. 8 is another cross-sectional view of the electrical connector shown in FIGS. 1-4, 6, and 7 illustrating the release member shown in FIG. 5 in an actuated position.

FIG. 7 is another cross-sectional view of the electrical connector 10. Referring now to FIGS. 3 and 7, the release member 48 is shown in the unactuated position. As shown in FIG. 3, an electrical wire 12 is installed to the corresponding electrical contact 40. Specifically, the contact beam 44 of the electrical contact 40 is in the partially closed position with the wire interface 46 of the contact beam 44 engaged in physical contact with the electrical wire 12 to electrically connect the electrical contact 40 to the electrical wire 12.

To uninstall the electrical wires 12 from the electrical contacts 40, the release member 48 can be pushed in the actuation direction C, for example by pushing on the ends 82 of the pusher extensions 80. Pushing the release member 48 in the actuation direction C moves the release member 48 in the actuation direction C from the unactuated position shown in FIGS. 3 and 7 to the actuated position shown in FIGS. 8 and 9. As shown in FIG. 7, the ends 86 (not shown in FIG. 3) of the springs 84 (not shown in FIG. 3) are engaged in physical contact with the wall 98 of the housing 24. As the release member 48 moves in the actuation direction C, the ends 86 of the springs 84 are deflected from the natural resting position thereof and the resilience of the springs 84 provides a spring force that resists movement of the release member 48 in the actuation direction C.

Referring now solely to FIG. 3, movement of the release member 48 in the actuation direction C from the unactuated position to the actuated position causes the ends 78 of the fingers 76 of the release member 48 to engage in physical contact with the corresponding contact beams 44 and thereby move the contact beams 44 from the fully or partially closed positions shown in FIG. 3 to the open positions shown in FIG. 9.

Referring now to FIG. 8, the release member 48 is shown in the actuated position wherein the springs 84 are resiliently deflected from the natural resting position thereof. The springs 84 thus bias the release member 48 in the unactuation direction D toward the unactuated position. In other words, the springs 84 bias the release member 48 away from the contact beams 44.

Referring now to FIG. 9, the fingers 76 are engaged in physical contact with the contact beams 44 of the corresponding electrical contacts 40 such that the contact beams 44 are in the open positions. In the open positions, the wire interfaces 46 of the contact beams 44 are disengaged from physical contact from the corresponding electrical wire 12. The open positions of the contact beams 44 represent an open position of the electrical contact 40 wherein the corresponding electrical wire 12 can be uninstalled from the electrical contact 40. Specifically, the electrical wires 12 can be pulled in the unactuation direction D to remove (i.e., release) the electrical wires 12 from the corresponding electrical contacts 40 and therefore from the electrical connector 10.

As should be apparent from a comparison of FIGS. 3 and 9, the release member 48 moves the contact beams 44 of the various electrical contacts 40 in different directions to move the contact beams 44 from the partially closed positions to the open positions thereof.

As should be understood from the Figures and description herein, in the illustrated embodiment, the contact beams 44 of all of the electrical contacts 40 of the electrical connector 10 are in the open positions when the release member 48 is in the actuated position. In other words, as the release member 48 is moved in the actuation direction C to the actuated position, the illustrated embodiment of the release member 48 moves the contact beams 44 of all of the electrical contacts 40 of the electrical connector 10 from the closed positions to the open positions thereof. The illustrated embodiment of the release member 48 thus holds the contact beams 44 of all of the electrical contacts 40 of the electrical connector 10 in the open positions at the same time. Accordingly, all of the electrical wires 12 that are terminated by the electrical contacts 40 of the electrical connector 10 can be simultaneously removed (i.e., released) from the corresponding electrical contacts 40 and thus from the electrical connector 10, for example by pulling on the individual electrical wires 12 and/or the cable 14.

In some other embodiments, the release member 48 moves the contact beams 44 of only a subset of the electrical contacts 40 of the electrical connector 10 from the closed positions to the open positions thereof. In other words, in some other embodiments, the release member 48 thus holds the contact beams 44 of only a subset of the electrical contacts 40 of the electrical connector 10 in the open positions at the same time. The subset may include any number of electrical contacts 40 greater than one.

Although the illustrated embodiment of the release member 48 simultaneously moves the contact beams 44 of the electrical contacts 40 from the fully or partially closed positions to the open positions thereof, alternatively the release member 48 may sequentially move some or all of the contact beams 44 of the electrical contacts 40 from the fully or partially closed positions to the open positions thereof, for example by providing different length fingers 76. In such other embodiments wherein the release member 48 sequentially moves some or all of the contact beams 44 of the electrical contacts 40 from the fully or partially closed positions to the open positions, the actuated position of the release member 48 holds the contact beams 44 of the some or all of the electrical contacts 40 (including any contact beams 44 that have been sequentially opened) in the open positions at the same time.

Once the electrical wires 12 have been removed (i.e., released) from the corresponding electrical contacts 40 and the pushing force is release from the release member 48, the springs 84 (FIGS. 5-8) move the release member 48 in the unactuation direction D from the actuated position to the unactuated position. The resilience of the contact beams 44 of the electrical contacts 40 causes the contact beams 44 to move (i.e., spring back) from the open positions to the fully closed positions.

By simultaneously holding the contact beam 44 of more than one electrical contact 40 in the open position, the actuated position of the release member 48 may make it easier to release more than one electrical wire 12 from the electrical contacts 40 of the electrical connector 10. For example, the actuated position of the release member 48 enables all or a subset of the electrical wires 12 that are terminated by the electrical contacts 40 of the electrical connector 10 to be simultaneously removed (i.e., released) from the corresponding electrical contacts 40 and thus to be simultaneously removed (i.e., released) from the electrical connector 10. Moreover, and for example, the actuated position of the release member 48 may enable all or a subset of the electrical wires 12 that are terminated by the electrical contacts 40 of the electrical connector 10 to be removed (i.e., released) from the corresponding electrical contacts 40 using less skill, using less complex and/or cheaper tools, and/or the like.

In some circumstances, the release member 48 is not used to install one or more of the electrical wires 12 to the corresponding electrical contact 40 (e.g., when the electrical wire 12 is larger than a predetermined size). For example, the release member 48 may remain in the unactuated position and the insertion force exerted by the electrical wire 12 on the corresponding contact beam(s) 44 may be sufficient to move the contact beam(s) 44 from the fully closed position toward the open position a sufficient amount such that the electrical wire 12 can be electrically connected to the contact beam(s) 44 without moving the release member 48 to the actuated position. In other circumstances (e.g., when the electrical wire 12 is smaller than a predetermined size), the release member 48 is moved to the actuated position to thereby open the contact beam(s) 44 of one or more electrical contacts 40 for installing an electrical wire 12 to the electrical contact 40.

The embodiments described and/or illustrated herein may provide an electrical connector wherein it is easier to remove (i.e., release) a plurality of electrical wires from electrical contacts of the electrical connector as compared to at least some known electrical connectors. Accordingly, it may be less expensive to rework, repair, and/or replace the electrical wires and/or various components of the electrical connector as compared to at least some known electrical connectors. The embodiments described and/or illustrated herein may enable a shorter cable jacket strip length (i.e., may enable less of the jacket 16 of the cable 14 to be stripped) and/or a greater service life of the electrical wires.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing extending between a mating end and a cable end, the housing having an internal chamber therein that is partially defined by a wall;

electrical contacts held by the housing between the mating end and the wall of the internal chamber, the electrical contacts comprising contact beams having wire interfaces configured to engage in physical contact with corresponding electrical wires that are received in the housing, the contact beams being movable between closed positions and open positions, the wire interface of each contact beam being configured to engage in physical contact with the corresponding electrical wire when the contact beam is in the closed position, the wire interface of each contact beam being configured to be disengaged from physical contact with the corresponding electrical wire when the contact beam is in the open position; and a release member movably held by the housing in the internal chamber between the wall and the cable end, the release member selectively movable within the internal chamber linearly towards and away from the contact beams, the release member including a base and multiple fingers that extend outward from the base toward corresponding contact beams, the fingers configured to engage in physical contact a plurality of the contact beams during movement of the release member towards the contact beams to move the plurality of the contact beams from the closed positions to the open positions thereof, the release member further including a spring extending between the base of the release member and the wall of the internal chamber, the spring biasing the release member away from the contact beams.

2. The electrical connector of claim 1, wherein the release member is configured to simultaneously move the plurality of contact beams from the closed positions to the open positions thereof.

3. The electrical connector of claim 1, wherein, when the plurality of contact beams are in the open positions, the corresponding electrical wires within the housing can be simultaneously released from the corresponding electrical contacts.

4. The electrical connector of claim 1, wherein the movement of the release member is configured to move all of the contact beams of all of the electrical contacts of the electrical connector from the closed positions to the open positions thereof.

5. The electrical connector of claim 1, wherein the release member is configured to be pushed towards the contact beams by at least one of a human operator directly, a human operator via the use of a tool, or an automated machine in order for the fingers of the release member to move the plurality of contact beams from the closed positions to the open positions.

6. The electrical connector of claim 1, wherein the spring biases the release member away from the contact beams with a resistance, the release member being configured to be moved towards the contact beams against the resistance of the spring in order for the fingers of the release member to move the plurality of the contact beams from the closed positions to the open positions thereof.

7. The electrical connector of claim 1, wherein the housing has an approximately circular form factor.

8. The electrical connector of claim 1, wherein the fingers of the release member are configured to move the plurality of contact beams in different directions to move the plurality of contact beams from the closed positions to the open positions thereof.

9. The electrical connector of claim 1, wherein the electrical contacts are poke-in contacts.

10. The electrical connector of claim 1, wherein the contact beam is a spring that is resiliently deflectable from the closed position.

11. The electrical connector of claim 1, further comprising a mating interface at which the electrical connector is configured to mate with another electrical connector in electrical connection therewith.

12. The electrical connector of claim 1, wherein the spring is integrally formed with the base of the release member as a single, unitary structure.

13. The electrical connector of claim 1, wherein the fingers extend from the base beyond the wall of the internal chamber to engage the corresponding contact beams.

14. The electrical connector of claim 1, wherein the base of the release member defines an opening therethrough, at least some of the electrical wires received in the housing extending through the opening in the base and beyond the wall of the internal chamber towards the contact beams.

15. The electrical connector of claim 1, wherein the base of the release member includes a pusher side and an opposite contact side, the fingers extending from the contact side of the base, the base further including pusher extensions that each extend outward from the pusher side of the base in a direction generally away from the electrical contacts.

16. The electrical connector of claim 15, wherein the housing includes an edge at the cable end, the pusher extensions of the base extending from the pusher side thereof to respective ends, the ends of the pusher extensions extending beyond the edge of the cable end of the housing.

17. An electrical connector comprising:

a housing extending between a mating end and a cable end, the housing defining an internal chamber, the housing configured to receive multiple electrical wires therein through the cable end;

electrical contacts held by the housing between the mating end and the internal chamber of the housing, the electrical contacts comprising contact beams having wire interfaces configured to engage in physical contact with corresponding electrical wires received in the housing, the contact beams being movable between closed positions and open positions, the wire interface of each contact beam being configured to engage in physical contact with the corresponding electrical wire when the contact beam is in the closed position, the wire interface of each contact beam being configured to be disengaged from physical contact with the corresponding electrical wire when the contact beam is in the open position; and a release member movably held by the housing within the internal chamber, the release member having a base extending between a pusher side and an opposite contact side, the base defining an opening therethrough between the pusher side and the contact side, at least some of the electrical wires received in the housing extending through the opening in the base to the contact beams, wherein the release member is selectively movable towards and away from the contact beams such that movement of the release member towards the contact beams is configured to move a plurality of the contact beams from the closed positions to the open positions thereof.

18. The electrical connector of claim 17, wherein the release member includes a spring that extends from the base generally towards the contact beams, the spring configured to engage a wall of the internal chamber to bias the release member away from the contact beams.

19. An electrical connector comprising:

a housing having a cylindrical shape extending along a central longitudinal axis;

electrical contacts held by the housing, the electrical contacts comprising contact beams that are spaced apart circumferentially from one another about the central longitudinal axis within the housing, the contact beams having wire interfaces configured to engage in physical contact with corresponding electrical wires that are received in the housing, the contact beams being movable between closed positions and open positions, the wire interface of each contact beam being configured to engage in physical contact with the corresponding electrical wire when the contact beam is in the closed position, the wire interface of each contact beam being configured to be disengaged from physical contact with the corresponding electrical wire when the contact beam is in the open position; and a release member movably held by the housing, the release member selectively movable within the housing along the central longitudinal axis towards and away from the contact beams such that movement of the release member towards the contact beams is configured to move a plurality of the contact beams from the closed positions to the open positions thereof, the release member further comprising a spring extending between the release member and a wall of the housing, the spring biasing the release member away from the contact beams.

20. The electrical connector of claim 19, wherein at least two of the contact beams of the electrical contacts extend in different directions as each other.

* * * * *